US006826530B1

(12) United States Patent
Kasai et al.

(10) Patent No.: US 6,826,530 B1
(45) Date of Patent: Nov. 30, 2004

(54) SPEECH SYNTHESIS FOR TASKS WITH WORD AND PROSODY DICTIONARIES

(75) Inventors: Osamu Kasai, Tokyo (JP); Toshiyuki Mizoguchi, Tokyo (JP)

(73) Assignees: Konami Corporation, Tokyo (JP); Konami Computer Entertainment Tokyo, Inc., Tokyo (JP)

( * ) Notice: Subject to any disclaimer, the term of this patent is extended or adjusted under 35 U.S.C. 154(b) by 748 days.

(21) Appl. No.: 09/621,544

(22) Filed: Jul. 21, 2000

(30) Foreign Application Priority Data

Jul. 21, 1999 (JP) ..... 11-205945

(51) Int. Cl.[7] ..... G10L 13/00; G10L 13/08
(52) U.S. Cl. ..... 704/258; 704/260
(58) Field of Search ..... 704/1, 10, 258, 704/266, 260, 261, 268, 269

(56) References Cited

U.S. PATENT DOCUMENTS 4,692,941 A * 9/1987 Jacks et al. ..... 704/260
5,384,893 A * 1/1995 Hutchins ..... 704/267
5,842,167 A * 11/1998 Miyatake et al. ..... 704/260
5,857,170 A * 1/1999 Kondo ..... 704/266
5,860,064 A * 1/1999 Henton ..... 704/260
5,905,972 A 5/1999 Huang
5,913,193 A * 6/1999 Huang et al. ..... 704/258
5,966,691 A * 10/1999 Kibre et al. ..... 704/260
6,101,470 A * 8/2000 Eide et al. ..... 704/260
6,144,939 A * 11/2000 Pearson et al. ..... 704/258
6,185,533 B1 * 2/2001 Holm et al. ..... 704/267
6,202,049 B1 * 3/2001 Kibre et al. ..... 704/267
6,529,874 B2 * 3/2003 Kagoshima et al. ..... 704/269
6,665,641 B1 * 12/2003 Coorman et al. ..... 704/260
6,701,295 B2 * 3/2004 Beutnagel et al. ..... 704/258
6,708,154 B2 * 3/2004 Acero ..... 704/260
6,725,199 B2 * 4/2004 Brittan et al. ..... 704/258
6,751,592 B1 * 6/2004 Shiga ..... 704/258

FOREIGN PATENT DOCUMENTS

JP 10116089 A2 5/1998

OTHER PUBLICATIONS

Katae et al., "Natural Prosody Generation for Domain Specific Text–to–Speech Systems," Fourth International Conference on Spoken Language, 1996. ICSLP 96. Oct. 3–6, 1996, vol. 3, pp. 1852 to 1855.*

* cited by examiner

*Primary Examiner*—Richemond Dorvil
*Assistant Examiner*—Martin Lerner
(74) *Attorney, Agent, or Firm*—Lowe Hauptman Gilman & Berner, LLP

(57) ABSTRACT

A plurality of tasks are set in a speech synthesizing process, in which at least one of speakers, emotion or situation at the time speeches are made, and contents of the speeches, is different, and word dictionaries, prosody dictionaries, and waveform dictionaries corresponding to respective tasks are organized. When a character string to be synthesized is input with the task specified through, for example, a game system, a speech synthesizing process is performed using the word dictionary, the prosody dictionary, and the waveform dictionary corresponding to the specified task. Therefore, a speech message can be generated depending on the personality of a speaker, the emotion or situation at the time when a speech is made, and the contents of the speech.

9 Claims, 9 Drawing Sheets

Fig. 5

| | |
|---|---|
| Normal | Leading 2 Moras + 'kun'<br>Examples: Yasuaki →Yasukun<br>Kazunori→Kazukun<br>Naoki →Naokun<br>Nobuo →Nobukun |
| 1-Mora Input | 1 Mora + '-' + 'kun'<br>Examples: Ka →Ka-kun<br>Shu →Shu-kun |
| Others | Aguri →(Agukun) →A-kun<br>Atsushi→(Atsukun) →Akkun<br>Nozomu→(Nozokun)→Nonnkun |

Fig. 6

| | |
|---|---|
| 1-Mora Word | A, Sho, ... |
| 2-Mora Word | Sho-, Shun, Teru, Yu-, Ken, Ke-, Ren, Shin, Ei, ...<br>⋮ |
| 3-Mora Word | Sho-ta, Kakeru, Kenta, Daichi, Daiki, Naoki, Ryota, Kazuki, ...<br>⋮ |
| 4-Mora Word | Ichiro-, Ryo-he-, Ko-he-, Ryo-suke, Sho-he-, Daisuke, ...<br>⋮ |
| 5-Mora Word | Kentaro-, Cho-taro-, E-taro-, E-jiro-, Ryu-nosuke, Kiichiro-, ...<br>⋮ |
| 6-Mora Word | Gen'ichiro-, ... |

SPEECH SYNTHESIS FOR TASKS WITH WORD AND PROSODY DICTIONARIES

BACKGROUND OF THE INVENTION

1. Field of the Invention

The present invention relates to a speech synthesizing method, a dictionary organizing method for speech synthesis, a speech synthesis apparatus, and a computer-readable medium recording a speech synthesis program for video games, etc.

2. Description of the Related Art

Recently, there has been a growing need to output a speech message from a machine with the propagation of services in which a speech message (language spoken by men and women) is to be repeatedly supplied as time information on the phone, the speech guidance, etc. of an ATM in a bank, and with a growing demand to improve a man-machine interface of various electric appliances, etc.

In a conventional method of outputting a speech message, a living person speaks predetermined words and sentences, which are stored in a storage device, and the stored data is reproduced and output as needed (hereinafter referred to as a "recording and reproducing method"). In another method of outputting a speech message, that is, a speech synthesizing method, speech data corresponding to various words forming a speech message is stored in a storage device, and the speech data is combined according to an optionally input character string (text).

In the above-mentioned recording and reproducing method, a high-quality speech message can be output. However, any speech message other than the predetermined words or sentences cannot be output. In addition, a storage device is required having a capacity proportional to the number of words and sentences to be output.

On the other hand, in the speech synthesizing method, a speech message corresponding to an optionally input character string, that is, an optional word, can be output, and a necessary storage capacity is smaller than that required in the above mentioned recording and reproducing method. However, there has been a problem that speech massages do not sound natural for some character strings.

In recent video games, with the improvement of performance of a game machine, and with an increasing volume of storage capacity of a storage medium, an increasing number of games are organized to output a speech message from a characters in the games together BGM or effect sound.

At this time, a product having an element of entertainment such as a video game is requested to output speech messages in different voices for respective game characters, and to output a speech message reflecting the emotion or situation at the time when the speech is made. Furthermore, there also is a demand to output the name (utterance) of a player character optionally input/set by a player as the utterance from a game character.

To realize the output of a speech massage based on the above mentioned demands in the recording and reproducing method, it is necessary to store and reproduce the entire speech of words of several thousands or several tens of thousands containing the names of player characters to be input or set by a player. Therefore, the time, cost, and capacity of a storage medium required to store necessary data largely increase. As a result, it is actually impossible to realize the process in the recording and reproducing method.

On the other hand, in the speech synthesizing method, it is relatively easy to utter the name of an optionally input/set player character. However, since the conventional speech synthesizing method only aims at generating a clear and natural speech message, it is quite impossible to synthesize a speech message depending on the personality of a speaker, the emotion and the situation at the time when a speech is made, that is, to output speech messages different in voice quality for each game character, or to output speech messages reflecting the emotion and the situation of a game character.

SUMMARY OF THE INVENTION

The present invention aims at providing a speech synthesizing method, a dictionary organizing method for speech synthesis, a speech synthesis apparatus, and a computer-readable medium recording a speech synthesis program which are capable of generating a speech message depending on the personality of a speaker, the emotion, the situation or various contents of a speech, and are applicable to a highly entertaining use such as a video game.

According to the present invention, to attain the above mentioned objects in the speech synthesizing method of generating a speech message using a word dictionary, a prosody dictionary, and a waveform dictionary, a plurality of operation units (hereinafter referred to as tasks) of a speech synthesizing process in which at least one of speakers, the emotion or situation at the time when speeches are made, and the contents of the speeches is different are set, at least prosody dictionaries and waveform dictionaries corresponding to respective tasks are organized, and when a character string whose speech is to be synthesized is input with the task specified, a speech synthesizing process is performed by using the word dictionary, the prosody dictionary, and the waveform dictionary corresponding to the task.

According to the present invention, the speech synthesizing process is performed by dividing the process into tasks such as plural speakers, plural types of emotion or situation at the time when speeches are made, plural contents of the speeches, etc., and by organizing dictionaries for respective tasks. Therefore, a speech message can be easily generated depending on the personality of a speaker, the emotion or situation at the time when a speech is made, and the contents of the speech.

In addition, each of the above mentioned dictionaries for respective tasks is organized by generating a word dictionary corresponding to each task, generating a speech recording scenario by selecting a character string which can be a model from all words in the word dictionary, recording the speech of a speaker based on the speech recording scenario, generating a prosody dictionary and a waveform dictionary from the recorded speech, and performing these operations on each task.

Each of the above mentioned dictionaries for respective tasks is organized by generating a word dictionary and word variation rules corresponding to each task, varying all words contained in the word dictionary corresponding each task according to the word variation rules corresponding each task, generating a speech recording scenario by selecting a character string which can be a model from all varied words in the word dictionary, recording the speech of a speaker based on the speech recording scenario, generating a prosody dictionary and a waveform dictionary from the recorded speech, and performing these operations on each task.

Each of the above mentioned dictionaries for respective tasks is organized by generating word variation rules corresponding to each task, varying all words contained in the word dictionary according to the word variation rules corresponding each task, generating a speech recording scenario by selecting a character string which can be a model from all varied words in the word dictionary, recording the speech of a speaker based on the speech recording scenario, generating a prosody dictionary and a waveform dictionary from the recorded speech, and performing these operations on each task.

According to the present invention, a speech recording scenario can be easily generated corresponding to each task, each dictionary can be organized by recording a speech based on the speech recording scenario, and a speech message containing various contents can be easily generated without increasing the capacity of a dictionary by performing a character string varying process.

Furthermore, a speech synthesizing method using the dictionaries is realized by switching a word dictionary, a prosody dictionary, and a waveform dictionary according to the designation of a task to be input together with a character string to be synthesized, and by synthesizing a speech message corresponding to a character string to be synthesized by using the switched word dictionary, prosody dictionary, and waveform dictionary.

At this time, when each dictionary is a word dictionary containing a number of words, each containing at least one character, together with respective accent types, a prosody dictionary containing a typical prosody model data in the prosody model data indicating the prosody of words contained in the word dictionary, and a waveform dictionary containing recorded speeches as speech data in synthesis units, the speech synthesizing process can be performed by determining the accent type of a character string to be synthesized from the word dictionary, selecting the prosody model data from the prosody dictionary based on the character string to be synthesized and the accent type, selecting waveform data corresponding to each character of the character string to be synthesized from the waveform dictionary based on the selected prosody model data, and connecting selected pieces of waveform data with each other.

Furthermore, another speech synthesizing method using the dictionaries is realized by switching a word dictionary, a prosody dictionary, a waveform dictionary, and word variation rules according to the designation of a task to be input together with a character string to be synthesized, varying the character string to be synthesized based on the word variation rules, and synthesizing a speech message corresponding to the varied character string by using the switched word dictionary, prosody dictionary, and waveform dictionary.

Furthermore, a further speech synthesizing method using the dictionaries is realized by switching a prosody dictionary, a waveform dictionary, and word variation rules according to the designation of a task to be input together with a character string to be synthesized, varying the character string to be synthesized based on the word variation rules, and synthesizing a speech message corresponding to the varied character string by using a word dictionary, and the switched prosody dictionary and waveform dictionary.

At this time, when each dictionary is a word dictionary containing a number of words, each containing at least one character, together with respective accent types, a prosody dictionary containing a typical prosody model data in the prosody model data indicating the prosody of words contained in the word dictionary, a waveform dictionary containing recorded speeches as speech data in synthesis units, and the word variation rules recording the variation rules of character strings, the speech synthesizing process can be performed by determining the accent type of a character string to be synthesized from the word dictionary or the word variation rules, selecting the prosody model data from the prosody dictionary based on the character string to be synthesized and the accent type, selecting waveform data corresponding to each character of the character string to be synthesized from the waveform dictionary based on the selected prosody model data, and connecting selected pieces of waveform data with each other.

A speech synthesis apparatus using the dictionaries comprises means for switching a word dictionary, a prosody dictionary, and a waveform dictionary according to the designation of a task input together with a character string to be synthesized, and means for synthesizing a speech message corresponding to the character string to be synthesized using the switched word dictionary, prosody dictionary, and waveform dictionary.

Another speech synthesis apparatus using the dictionaries comprises means for switching a word dictionary, a prosody dictionary, a waveform dictionary, and word variation rules according to the designation of a task input together with a character string to be synthesized, means for varying the character string to be synthesized according to the word variation rules, and means for synthesizing a speech message corresponding to the varied character string using the switched word dictionary, prosody dictionary, and waveform dictionary.

A further speech synthesis apparatus using the dictionaries comprises means for switching a prosody dictionary, a waveform dictionary, and word variation rules according to the designation of a task input together with a character string to be synthesized, means for varying the character string to be synthesized according to the word variation rules, and means for synthesizing a speech message corresponding to the varied character string using a word dictionary, and the switched prosody dictionary and waveform dictionary.

The above mentioned speech synthesis apparatus can be realized by a computer-readable storage medium storing a speech synthesis program used to direct a computer to perform the functions of a word dictionary, a prosody dictionary, and a waveform dictionary corresponding to each of the plurality of tasks of a speech synthesizing process in which at least one of speakers, emotion or situation at the time when speeches are made, and the contents of the speeches is different, means for switching the word dictionary, the prosody dictionary, and the waveform dictionary according to the designation of a task input together with a character string to be synthesized, and means for synthesizing a speech message corresponding to the character string to be synthesized using the switched word dictionary, prosody dictionary, and waveform dictionary.

The above mentioned speech synthesis apparatus can be realized by a computer-readable storage medium storing a speech synthesis program used to direct a computer to perform the functions of a word dictionary, a prosody dictionary, a waveform dictionary, and word variation rules corresponding to each of the plurality of tasks of a speech synthesizing process in which at least one of speakers, emotion or situation at the time when speeches are made, and the contents of the speeches is different, means for switching the word dictionary, the prosody dictionary, the waveform dictionary, and the word variation rules according to the designation of a task input together with a character string to be synthesized, means for varying the character string to be synthesized according to the word variation rules, and means for synthesizing a speech message corresponding to the varied character string using the switched word dictionary, prosody dictionary, and waveform dictionary.

The above mentioned speech synthesis apparatus can be realized by a computer-readable storage medium storing a speech synthesis program used to direct a computer to perform the function of a word dictionary and the function of prosody dictionaries, waveform dictionaries, and word variation rules corresponding to each of the plurality of tasks of a speech synthesizing process in which any of speakers, emotion at the time when speeches are made, and situation at the time when speeches are made are different from each other, means for switching the prosody dictionary, the waveform dictionary, and the word variation rules according to the designation of a task input together with a character string to be synthesized, means for varying the character string to be synthesized according to the word variation rules, and means for synthesizing a speech message corresponding to the varied character string using the word dictionary, the switched prosody dictionary and waveform dictionary.

The above mentioned objects, other objects, features, and merits of the present invention will be clearly described below by referring to the attached drawings.

BRIEF DESCRIPTION OF THE DRAWINGS

FIG. 5 shows an example of word variation rules;

FIG. 6 shows an example of a selected character string;

DESCRIPTION OF THE PREFERRED EMBODIMENTS

Figure 1:
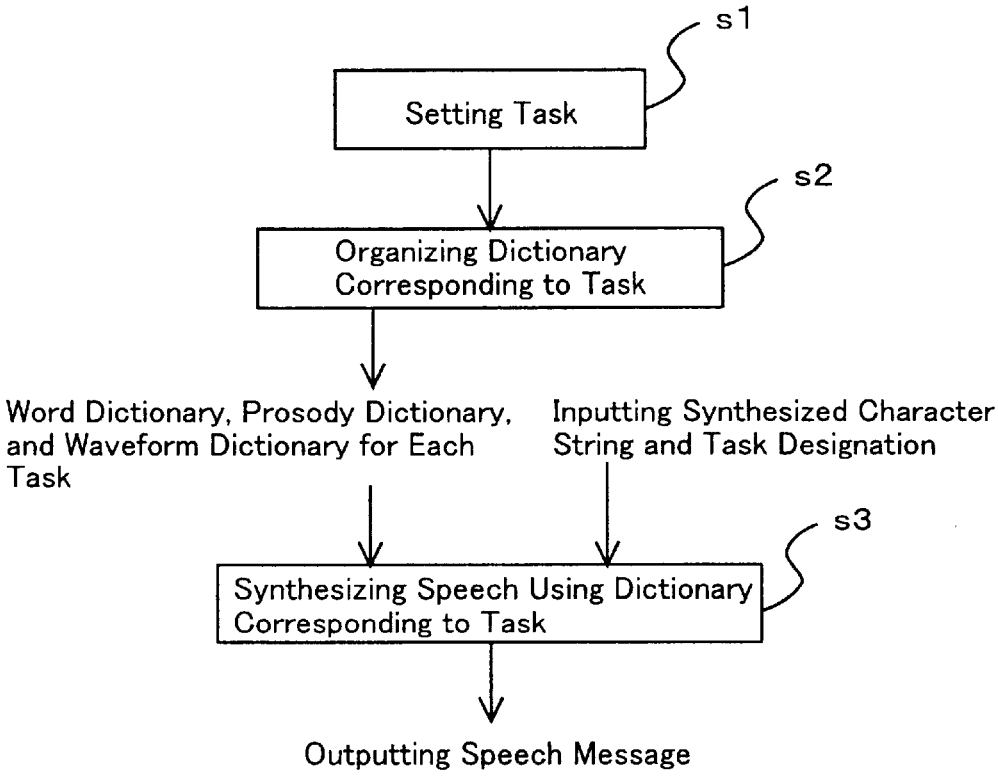
FIG. 1 is a flowchart of the entire speech synthesizing method according to the present invention.

FIG. 1 shows the flow of the speech synthesizing method according to the present invention, that is, the entire flow of the speech synthesizing method in a broad sense including the organization of a dictionary for a speech synthesis.

First, a plurality of tasks of the speech synthesizing process in which at least one of speakers, emotion or situation at the time when speeches are made, and the contents of the speeches are different are set (s1). This operation is manually performed depending on the purpose of the speech synthesis.

Figure 2:
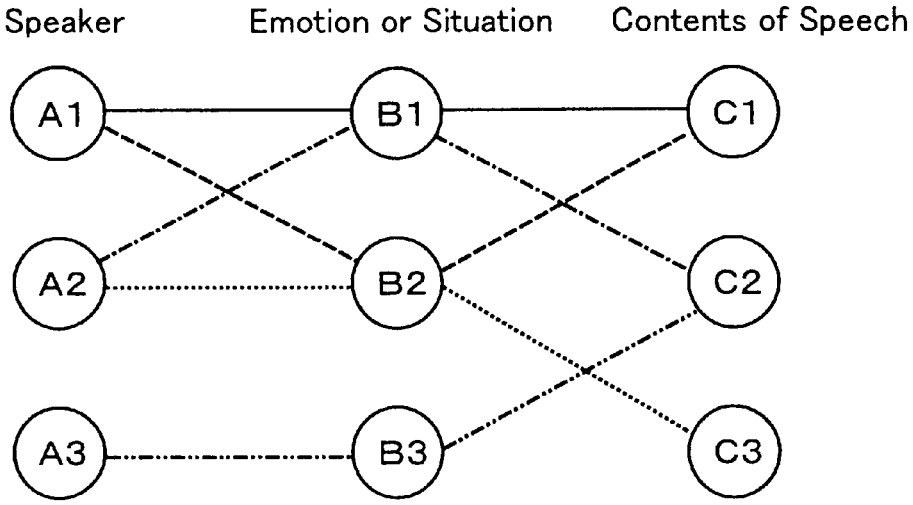
FIG. 2 is an explanatory view of tasks.

FIG. 2 is an explanatory view of tasks. In FIG. 2, reference numerals A1, A2, and A3 denote a plurality of different speakers, reference numerals B1, B2, and B3 denote plural settings of different emotion or situation, and reference numerals C1, C2, and C3 denote plural settings of different contents of speeches. The contents of speeches do not refer to a single word, but refer to a set of words according to predetermined definitions such as words of call, joy, etc.

In FIG. 2, a case (A1-B1-C1) in which a speaker A1 makes a speech whose contents are C1 in emotion or situation B1 is a task, and a case (A1-B2-C1) in which a speaker A1 makes a speech whose contents are C1 in emotion or situation B2 is another task. Similarly, a case (A2-B1-C2) in which a speaker A2 makes a speech whose contents are C2 in emotion or situation B1, a case (A2-B2-C3) in which a speaker A2 makes a speech whose contents are C3 in emotion or situation B2, and a case (A3-B3-C2) in which a speaker A3 makes a speech whose contents are C2 in emotion or situation B3 are all other tasks.

A task covering all of a plurality of speakers, plural settings of emotion or situation, and plural settings of contents of speeches is not always set. That is, for the speaker A1, the emotion or situation B1, B2, and B3 are set. For the emotion or situation B1, B2, and B3, the contents of speeches C1, C2, and C3 are respectively set. Thus, even if a total of 9 tasks are set, only the emotion or situation B1 and B2 are set for the speaker A2, only the contents of speeches C1 and C2 are set for the emotion or situation B1, and only the contents of speeches C3 is set for the emotion or situation B2. As a result, in this case, a total of only 3 tasks are set. What task is to be set depends on the purpose of a speech synthesis.

In this example, there are a plurality of speakers, plural settings of emotion or situation, and plural settings of contents. However, a task can be set with any one or two of speakers, emotion or situation, and contents limited to one type only.

Figure 3:
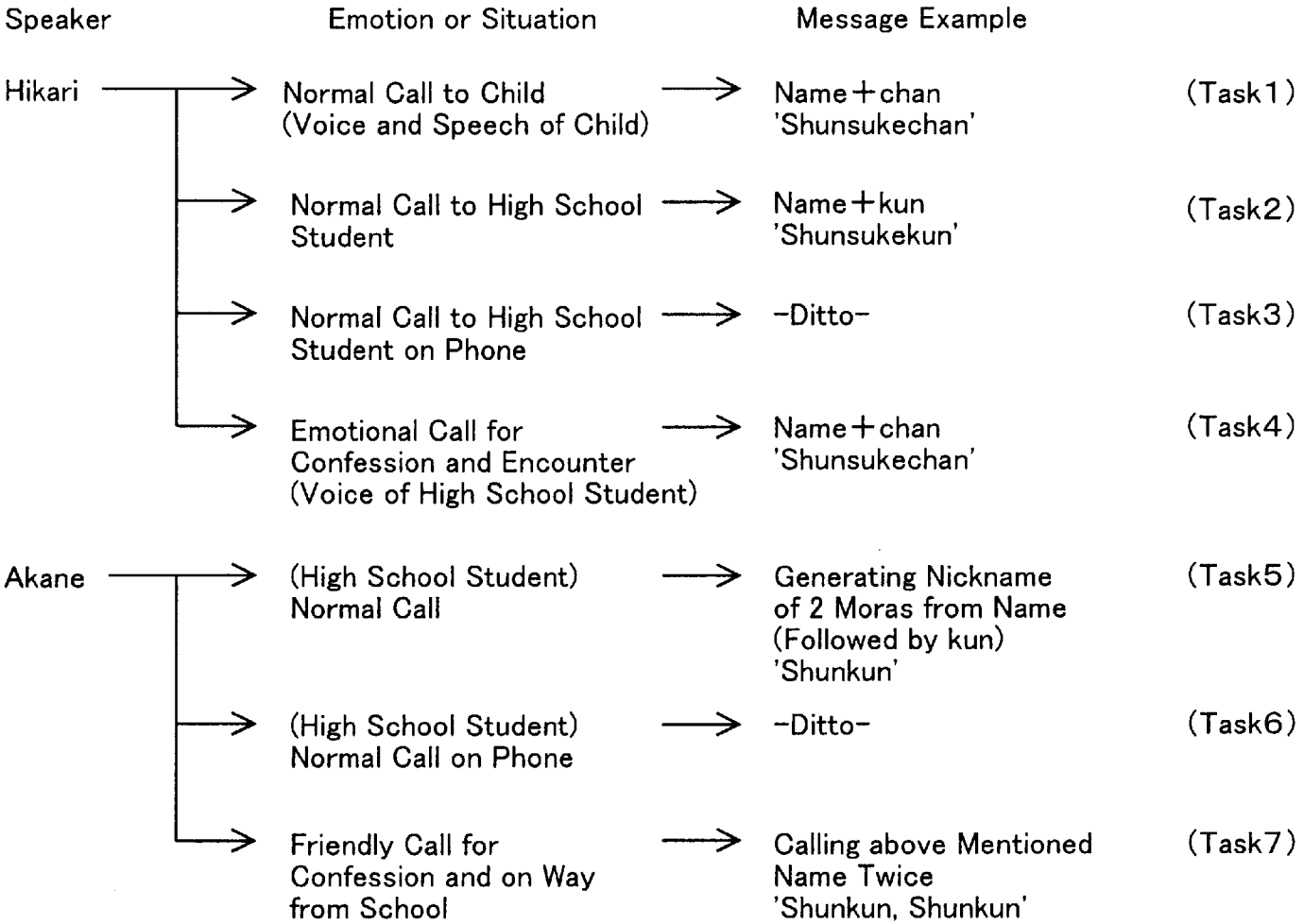
FIG. 3 shows an example of a concrete task.

FIG. 3 shows an example of a concrete task in which a speech message of a game character in a video game is to be synthesized, and specifically an example of the contents of a speech limited to a call to a player character.

In FIG. 3, four types of emotion or situation, that is, a 'normal call to a small child,' a 'normal call to a high school student,' a 'normal call to a high school student on a phone,' and a 'emotional call for confession or encounter,' are set for the speaker (game character) named 'Hikari' They are set as individual tasks 1, 2, 3, and 4. For a speaker named 'Akane,' three types of emotion or situation, that is, a 'normal call,' a 'normal call on a phone,' and a 'friendly call for confession or on a way from school' are set as individual tasks 5, 6, and 7.

An example of a message in each task is a word variation process for each task described later. In FIG. 3, 'chan' and 'kun' are friendly expressions in Japanese.

For each of the tasks as set above, dictionaries, that is, a word dictionary, a prosody dictionary, and a waveform dictionary, are organized (s2).

In this example, a word dictionary refers to a dictionary storing a large number of words, each containing at least one character together with their accent types. For example, in the task shown in FIG. 3, a number of words indicating the names of a player character expected to be input are stored with their accent types. A prosody dictionary refers to a dictionary storing a number of pieces of typical prosody model data in the prosody model data indicating the prosody of the words stored in the word dictionary. A waveform dictionary refers to a dictionary storing a number of recorded speeches as speech data (pieces of phoneme) in synthesis units.

If a word variation process is performed on the word dictionary, the word dictionary can be shared among the tasks different in speaker or emotion or situation. Especially, if the contents of speeches are limited to one type, only one word dictionary will do.

When a character string to be synthesized is input with a task specified through input means, a game system, etc. not shown in the attached drawings, the speech synthesizing process is performed using the word dictionary, the prosody dictionary, and the waveform dictionary corresponding to the task (s3).

Figure 4:
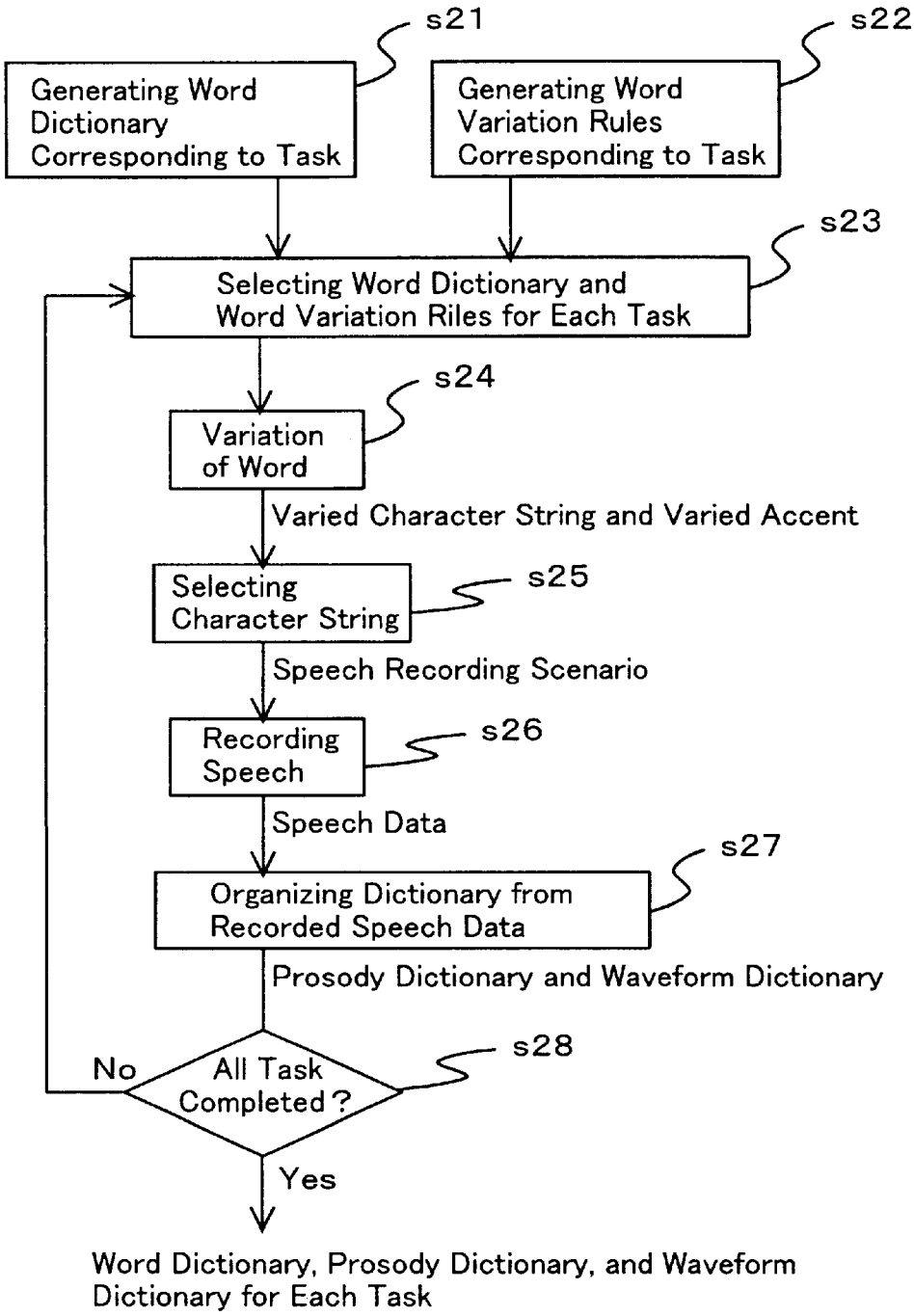
FIG. 4 is a flowchart of the dictionary organizing method for the speech synthesis according to the present invention.

FIG. 4 shows a flow of the dictionary organizing method for the speech synthesis according to the present invention.

First, word dictionaries corresponding to speakers, emotion or situation at the time when speeches are made, and the contents of speeches of a plurality of the set tasks are manually generated (s21). At this time, word variation rules are generated at need (s22).

Word variation rules are rules for converting words contained in the word dictionary into words corresponding to tasks different in speaker, emotion or situation. In this converting process, a word dictionary can be virtually used as a plurality of word dictionaries respectively corresponding to the tasks different in speakers, emotion or situation as described above.

FIG. 5 shows an example of the word variation rules. Practically, FIG. 5 shows an example of the variation rules corresponding to the task 5 referring to FIG. 3, that is, the rules used when nicknames of 2 moras are generated from a name (name of a player character) as a call to the player character.

Then, according to the generated word dictionary, or word dictionary, and word variation rules, a word dictionary, or a word dictionary and word variation rules corresponding a task is selected (s23). If there are word variation rules, a word variation process is performed (s24).

The word variation process is performed by varying all words contained in a word dictionary corresponding to a task according to the word variation rules corresponding to the task.

In the examples shown in FIGS. 3 and 5, the name of a player character is retrieved one by one. When a normal name of 2 or more moras is detected, the characters of the leading 2 moras are followed by 'kun.' When the detected name is a name of one mora, the characters corresponding to the one mora are followed by a '-(long sound)' and 'kun.' When the detected name is a particular name, it is varied by being followed by '-' or other variations such as log sound, double consonant and syllabic nasal to make an appropriate nickname. When a nickname is generated, a variation in accent in which heading is accented can be considered.

Then, from all words contained in the word dictionary or all words processed in the above mentioned word variation process, a character string is selected according to character string selection rules to generate a speech recording scenario (s25).

Character string selection rules refer to rules defined for selection of character strings which can be models from all words contained in the word dictionary or all words processed in the above mentioned word variation process. For example, when a character string which can be a model, that is, a name, is selected from a word dictionary storing a large number of the above mentioned names of player characters, 1) names of 1 mora to 6 moras, 2) selecting at least one word for each accent type which is different for each mora, etc. are defined. FIG. 6 shows an example of a character string selected according to the rules.

A word contained in a word dictionary is the more strictly limited in its pattern when the contents of speeches are defined in the narrower sense, and there are the more words when the similarity level becomes the higher. When there are a large number of words having high similarity levels in a word dictionary, each word is assigned information indicating an importance level and an occurrence probability (frequency), and the selection standard of the information is included in the character string selection rules together with the number of moras and the designation of an accent type, thereby improving the probability that a character string input as a character string to be synthesized, or a similar character string in the actual speech synthesis can be contained in the speech recording scenario. Thus, the quality of the actual speech synthesis can be enhanced.

Then, a speaker's speech is recorded according to the speech recording scenario corresponding to the task generated as described above (s26). It is a normal process in which a speaker corresponding to a task is invited to a studio, etc. speeches made according to a scenario are recorded through a microphone, and the speeches are recorded by a tape-recorder, etc.

Finally, a prosody dictionary and a waveform dictionary are organized from the recorded speeches (s27). The process of organizing a dictionary according to the recorded voice is not an object of the present invention, and a well-known algorithm and process method can be used as is. Therefore, the detailed explanation is omitted here.

The above mentioned process is repeated for all tasks (s28). As described above, when a word dictionary is virtually processed as a plurality of word dictionaries respectively corresponding to tasks different in speakers, emotion or situation in a word variation process, the word dictionary is used as is, and only word variation rules corresponding to different tasks are selected. In addition, it is not always necessary to perform all processes in steps S24 to S27 in order for each task, but the processes can be concurrently performed.

Figure 7:
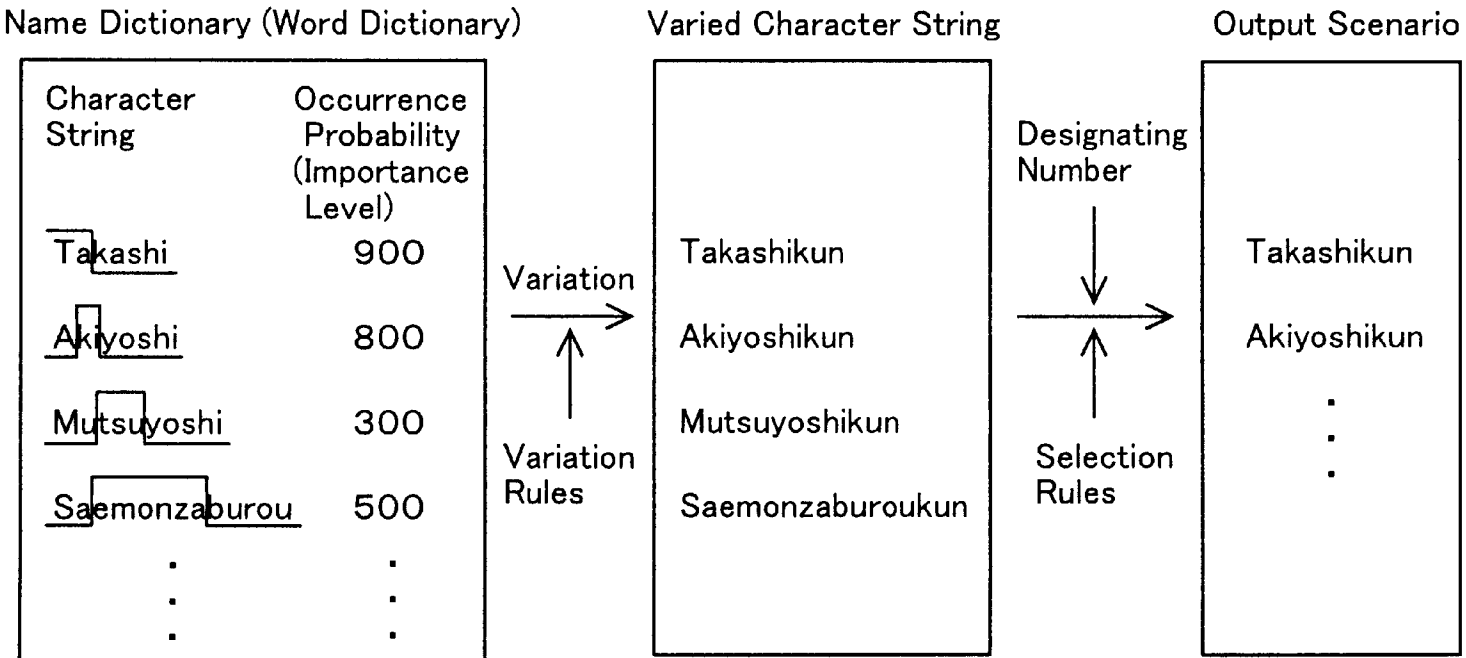
FIG. 7 shows an example of a process of generating a speech recording scenario according to a word dictionary, word variation rules, and character string selection rules.

FIG. 7 shows an example of varying the words stored in the word dictionary corresponding to a predetermined task according to the word variation rules corresponding the task, and generating a speech recording scenario corresponding to a predetermined task by selecting words according to the character string selection rules.

The word variation rules are the variation rules corresponding the task 2 described by referring to FIG. 3, that is, the rules used when a name (name of a player character) is followed by 'kun' when the player character is addressed. In addition, the character string selection rules are represented by 1) varied words of 3 moras to 8 moras, 2) at least one word having different accent types for all moras, 3) a word having high occurrence probability is prioritized, and 4) number of character strings stored in a scenario is preliminarily determined (selection is completed when a specified value is exceeded).

In the present embodiment, both 'Akiyoshikun' and 'Mutsuyoshikun' are 6 moras, and have high tone at the center (indicated by solid line in FIG. 7. Since 'Akiyoshi' has a higher occurrence probability, 'Akiyoshikun' is selected and output to the scenario. Since 'Saemonzaburoukun' is 10 moras, it is not output to the scenario.

The dictionary organizing method for the speech synthesis described above contains a manual dictionary generating operation and a field operation such as a speech recording operation, etc. Therefore, all processes cannot be realized by an apparatus or a program, but a word varying process and a character string selecting process can be realized by an apparatus or a program which perform a process according to respective rules.

Figure 8:
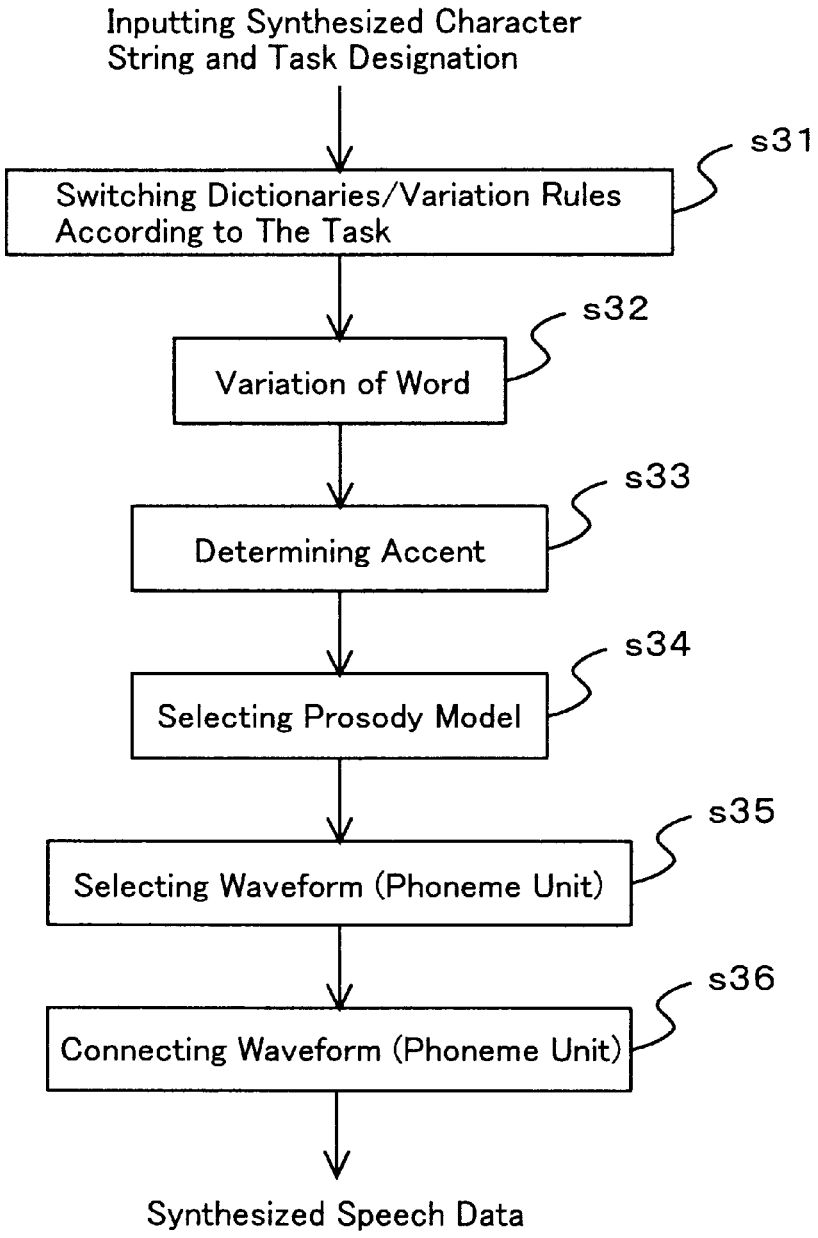
FIG. 8 is a flowchart of the speech synthesizing method according to the present invention.

FIG. 8 shows a flow of the speech synthesizing method in a narrow sense in which an actual speech synthesizing process is performed using a word dictionary, prosody dictionary, and waveform dictionary for each task generated as described above.

First, when a character string to be synthesized and designation of a task are input through input means, a game system, etc. not shown in the attached drawings, the word dictionary, the prosody dictionary, and the waveform dictionary are switched according to the designation of the task. When the word variation process is performed at the stage of organizing a dictionary, the word variation rules are switched additionally (s31).

When the word variation process is performed at the stage of organizing a dictionary, the word variation process is performed on a character string to be synthesized according to the switched word variation rules (s32). The word variation rules used in the present embodiment are basically the rules used at the stage of organizing a dictionary as is.

Then, the accent type of the character string to be synthesized is determined based on the word dictionary or the word variation rules (s33). Practically, the character string to be synthesized is compared with the word stored in the word dictionary. If the same words are detected, the accent type is adopted. If they are not detected, the accent type of the word having a similar character string is adopted in the words having the same values of moras. When the same words are not detected, it can be organized such that a word can be optionally selected by an operator (game player) from all accent types probable for the words having the same value of moras as that of the character string to be synthesized through input means not shown in the attached drawings.

At this time, when the accent varying process is performed as described above in the dictionary organizing process at the stage of the word variation process, the accent type is adopted according to the word variation rules.

Then, the prosody model data is selected from the prosody dictionary based on the character string to be synthesized and the accent type (S34), the waveform data corresponding to each character in the character string to be synthesized is selected from the waveform dictionary according to the selected prosody model data (s35), the selected pieces of waveform data are connected to each other (s36), and the speech data is synthesized.

The details of the processes in s34 to s36 are not the objects of the present invention. Therefore, a well-known algorithm and processing method can be used as is, thereby omitting the detailed explanation.

Figure 9:
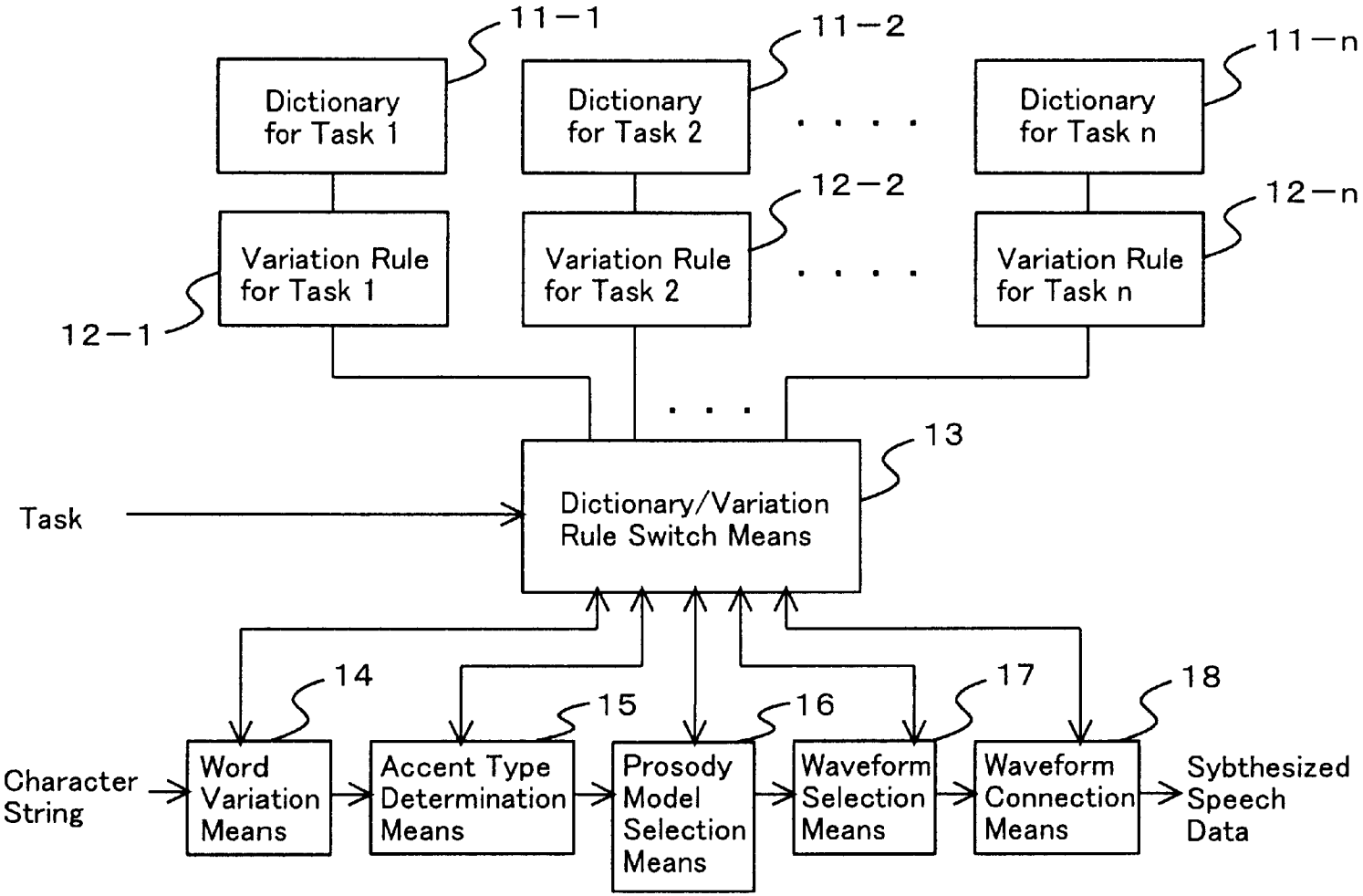
FIG. 9 is a block diagram of the speech synthesis apparatus according to the present invention.

FIG. 9 is a block diagram of the functions of the speech synthesis apparatus according to the present invention. In FIG. 9, reference numerals 11-1, 11-2, . . . , 11-n denote dictionaries for task 1, task 2, . . . , and task n, reference numerals 12-1, 12-2, . . . , 12-n denote variation rules for task 1, task 2, . . . , and task n, a reference numeral 13 denotes dictionary/word variation rule switch means, a reference numeral 14 denotes word variation means, a reference numeral 15 denotes accent type determination means, a reference numeral 16 denotes prosody model selection means, a reference numeral 17 denotes waveform selection means, and a reference numeral 18 denotes waveform connection means.

The dictionaries 11-1 to 11-n for tasks 1 to n are (the storage units of) the word dictionaries, the prosody dictionaries, and the waveform dictionaries respectively for the tasks 1 to n. In addition, the variation rules 12-1 to 12-n for tasks 1 to n are (the storage units of) the word variation rules respectively for the tasks 1 to n.

The dictionary/variation rule switch means 13 switches and selects one of the dictionaries 11-1 to 11-n for tasks 1 to n, and one of the variation rules 12-1 to 12-n for tasks 1 to n available based on the designation of a task input together with a character string to be synthesized, and provides the selected dictionaries and rules to each unit.

The word variation means 14 varies the character string to be synthesized according to the selected word variation rules. The accent type determination means 15 determines the accent type of the character string to be synthesized based on the selected word dictionary or word variation rules.

The prosody model selection means 16 selects prosody model data from the selected prosody dictionary according to the character string to be synthesized and the accent type. The waveform selection means 17 selects the waveform data corresponding to each character in the character string to be synthesized based on the selected prosody model data from the selected waveform dictionary. The waveform connection means 18 connects the selected pieces of waveform data to each other, and synthesizes speech data.

The preferred aspects of the present invention described in this specification have been described only as examples, and are not limited to the applications. The scope of the present invention is listed in the attached claims, and all variations in the scope of the claims are included in the present invention.

What is claimed is:

1. A speech synthesizing method using word dictionaries, prosody dictionaries, and waveform dictionaries corresponding to a plurality of tasks of a speech synthesizing process in which at least one of speakers, emotion or situation when speeches are made, and contents of the speeches is different, comprising the steps of:

switching among a word dictionary, a prosody dictionary, and a waveform dictionary according to designation of a task to be input together with a character string to be synthesized; and synthesizing a speech message corresponding to a character string to be synthesized by using the switched word dictionary, prosody dictionary, and waveform dictionary, each dictionary including:

(a) a word dictionary including a number of words, each having at least one character, together with respective accent types, (b) a prosody dictionary including typical prosody model data in prosody model data indicating prosody of words in the word dictionary, and (c) a waveform dictionary including recorded speeches as speech data in synthesis units, the speech synthesizing process comprising the steps of:

determining an accent type of a character string to be synthesized from the word dictionary;

selecting prosody model data from the prosody dictionary based on the character string to be synthesized and the accent type;

selecting waveform data corresponding to each character of the character string to be synthesized based on the selected prosody model data from the waveform dictionary; and connecting selected pieces of waveform data.

2. A speech synthesizing method using word dictionaries, prosody dictionaries, waveform dictionaries, and word variation rules corresponding to a plurality of tasks of a speech synthesizing process in which at least one of speakers, emotion or situation when speeches are made, and contents of the speeches is different, comprising the steps of:

switching among a word dictionary, a prosody dictionary, a waveform dictionary, arid word variation rules according to designation of a task to be input together with a character string to be synthesized;

varying the character string to be synthesized according to the word variation rules; and synthesizing a speech message corresponding to the varied character string by using the switched word dictionary, prosody dictionary, and waveform dictionary, each dictionary including:

(a) a word dictionary including a number of words, each having at least one character, together with respective accent types, (b) a prosody dictionary including a typical prosody model data in prosody model data indicating prosody of words in the word dictionary, (c) a waveform dictionary including recorded speeches as speech data in synthesis units, and (d) word variation rules for recording variation rules of character strings, the speech synthesizing process comprising the steps of:

determining an accent type of a character string to be synthesized from the word dictionary or the word variation rules;

selecting prosody model data from the prosody dictionary based on the character string to be synthesized and the accent type;

selecting waveform data corresponding to each character of the character string to be synthesized based on the selected prosody model data from the waveform dictionary; and connecting selected pieces of waveform data.

3. A speech synthesizing method using a word dictionary and using prosody dictionaries, waveform dictionaries, and word variation rules corresponding to each of a plurality of tasks of a speech synthesizing process in which any of speakers, emotion when speeches are made, and situation when speeches are made is different, comprising the steps of:

switching among a prosody dictionary, a waveform dictionary, and word variation rules according to designation of a task to be input together with a character string to be synthesized;

varying the character string to be synthesized according to the word variation rules; and synthesizing a speech message corresponding to the varied character string by using a word dictionary, the switched prosody dictionary and waveform dictionary, each dictionary including:

(a) a word dictionary including a number of words, each having at least one character, together with respective accent types, (b) a prosody dictionary including a typical prosody model data in prosody model data indicating prosody of words in the word dictionary, (c) a waveform dictionary including recorded speeches as speech data in synthesis units, and (d) word variation rules for recording variation rules of character strings, the speech synthesizing process comprising the steps of:

determining an accent type of a character string to be synthesized from the word dictionary or the word variation rules;

selecting prosody model data from the prosody dictionary based on the character string to be synthesized and the accent type;

selecting waveform data corresponding to each character of the character string to be synthesized based on the selected prosody model data from the waveform dictionary; and connecting selected pieces of waveform data.

4. A speech synthesis apparatus using word dictionaries, prosody dictionaries, and waveform dictionaries corresponding to a plurality of tasks of a speech synthesizing process in which at least one of speakers, emotion or situation when speeches are made, and contents of the speeches is different, comprising:

switches for switching among a word dictionary, a prosody dictionary, and a waveform dictionary according to designation of a task to be input together with a character string to be synthesized; and a synthesizer for synthesizing a speech message corresponding to a character string to be synthesized by using the switched word dictionary, prosody dictionary, and waveform dictionary, each dictionary including:

(a) a word dictionary including a number of words, each having at least one character, together with respective accent types, (b) a prosody dictionary including a typical prosody model data in prosody model data indicating prosody of words in the word dictionary, and (c) a waveform dictionary including recorded speeches as speech data in synthesis units, a speech synthesizing processor being arranged for:

(a) determining an accent type of a character string to be synthesized from the word dictionary;

(b) selecting prosody model data from the prosody dictionary based on the character string to be synthesized and the accent type;

(c) selecting waveform data corresponding to each character of the character string to be synthesized based on the selected prosody model data from the waveform dictionary; and (d) connecting selected pieces of waveform data.

5. A speech synthesis apparatus using word dictionaries, prosody dictionaries, waveform dictionaries, and word variation rules corresponding to a plurality of tasks of a speech synthesizing process in which at least one of speakers, emotion or situation when speeches are made, and contents of the speeches is different, comprising:

switches for switching among a word dictionary, a prosody dictionary, a waveform dictionary, and word variation rules according to designation of a task to be input together with a character string to be synthesized;

a processor arrangement for varying the character string to be synthesized according to the word variation rules; and a synthesizer for synthesizing a speech message corresponding to the varied character string by using the switched word dictionary, prosody dictionary, and waveform dictionary, each dictionary including:

(a) a word dictionary including a number of words, each having at least one character, together with respective accent types, (b) a prosody dictionary including a typical prosody model data in prosody model data indicating prosody of words in the word dictionary, (c) a waveform dictionary including recorded speeches as speech data in synthesis units, and (d) word variation rules for recording variation rules of character strings, a speech synthesizing processor being arranged for:

(a) determining an accent type of a character string to be synthesized from the word dictionary or the word variation rules;

(b) selecting prosody model data from the prosody dictionary based on the character string to be synthesized and the accent type;

(c) selecting waveform data corresponding to each character of the character string to be synthesized based on the selected prosody model data from the waveform dictionary; and (d) connecting selected pieces of waveform data.

6. A speech synthesis apparatus using a word dictionary and using prosody dictionaries, waveform dictionaries, and word variation rules corresponding to each of a plurality of tasks of a speech synthesizing process in which any of speakers, emotion when speeches are made, and situation when speeches are made is different, comprising:

switches for switching among a prosody dictionary, a waveform dictionary, and word variation rules according to designation of a task to be input together with a character string to be synthesized;

a processor arrangement for varying the character string to be synthesized according to the word variation rules; and a synthesizer for synthesizing a speech message corresponding to the varied character string by using a word dictionary, the switched prosody dictionary and waveform dictionary, each dictionary including:

(a) a word dictionary including a number of words, each having at least one character, together with respective accent types, (b) a prosody dictionary including a typical prosody model data in prosody model data indicating prosody of words in the word dictionary, (c) a waveform dictionary including recorded speeches as speech data in synthesis units, and (d) word variation rules for recording variation rules of character strings, a speech synthesizing processor being arranged for:

(a) determining an accent type of a character string to be synthesized from the word dictionary or the word variation rules;

(b) selecting prosody model data from the prosody dictionary based on the character string to be synthesized and the accent type;

(c) selecting waveform data corresponding to each character of the character string to be synthesized based on the selected prosody model data from the waveform dictionary; and (d) connecting selected pieces of waveform data.

7. A computer-readable medium storing a speech synthesis program used to direct a computer to function as:

word dictionaries, prosody dictionaries, and waveform dictionaries corresponding to a plurality of tasks of a speech synthesizing process in which at least one of speakers, emotion or situation when speeches are made, and contents of the speeches is different;

switches for switching among a word dictionary, a prosody dictionary, and a waveform dictionary according to designation of a task to be input together with a character string to be synthesized;

a synthesizer for synthesizing a speech message corresponding to a character string to be synthesized by using the switched word dictionary, prosody dictionary, and waveform dictionary, each dictionary including:

(a) a word dictionary including a number of words, each having at least one character, together with respective accent types, (b) a prosody dictionary including a typical prosody model data in prosody model data indicating prosody of words contained in the word dictionary, and (c) a waveform dictionary including recorded speeches as speech data in synthesis units; and a speech synthesizing processor being arranged for:

(a) determining an accent type of a character string to be synthesized from the word dictionary;

(b) selecting prosody model data from the prosody dictionary based on the character string to be synthesized and the accent type;

(c) selecting waveform data corresponding to each character of the character string to be synthesized based on the selected prosody model data from the waveform dictionary; and (d) connecting selected pieces of waveform data.

8. A computer-readable medium storing a speech synthesis program used to direct a computer to function as:

word dictionaries, prosody dictionaries, waveform dictionaries, and word variation rules corresponding to a plurality of tasks of a speech synthesizing process in which at least one of speakers, emotion or situation when speeches are made, and contents of the speeches is different, the program causing the computer to:

(a) switch among at least one of the word dictionaries, prosody dictionaries, waveform dictionaries, and word variation rules according to designation of a task to be input together with a character string to be synthesized;

(b) vary the character string to be synthesized according to the word variation rules; and (c) synthesize a speech message corresponding to the varied character string by using the switched word dictionary, prosody dictionary, and waveform dictionary, each dictionary including:

(i) a word dictionary including a number of words, each having at least one character, together with respective accent types, (ii) a prosody dictionary including a typical prosody model data in prosody model data indicating prosody of words contained in the word dictionary, (iii) a waveform dictionary including recorded speeches as speech data in synthesis units, and (iv) word variation rules for recording variation rules of character strings;

(d) determine an accent type of a character string to be synthesized from the word dictionary or the word variation rules;

(e) select prosody model data from the prosody dictionary based on the character string to be synthesized and the accent type;

(f) select waveform data corresponding to each character of the character string to be synthesized based on the selected prosody model data from the waveform dictionary; and (g) connect selected pieces of waveform data.

9. A computer-readable medium storing a speech synthesis program used to direct a computer to function as:

a word dictionary;

prosody dictionaries, waveform dictionaries, and word variation rules corresponding to each of a plurality of tasks of a speech synthesizing process in which any of speakers, emotion when speeches are made, and situation when speeches are made is different;

switches for switching among a prosody dictionary, a waveform dictionary, and word variation rules according to designation of a task to be input together with a character string to be synthesized;

a processor arrangement for varying the character string to be synthesized according to the word variation rules; and a synthesizer for synthesizing a speech message corresponding to the varied character string by using a word dictionary, the switched prosody dictionary and waveform dictionary, each dictionary including:

(a) a word dictionary including a number of words, each having at least one character, together with respective accent types, (b) a prosody dictionary including a typical prosody model data in prosody model data indicating prosody of words contained in the word dictionary, (c) a waveform dictionary including recorded speeches as speech data in synthesis units, and (d) word variation rules for recording variation rules of character strings;

a speech synthesizing processor being arranged for:

(a) determining an accent type of a character string to be synthesized from the word dictionary or the word variation rules;

(b) selecting prosody model data from the prosody dictionary based on the character string to be synthesized and the accent type;

(c) selecting waveform data corresponding to each character of the character string to be synthesized based on the selected prosody model data from the waveform dictionary; and (d) connecting selected pieces of waveform data.

* * * * *